US012808586B2

(12) United States Patent
Aoki et al.

(10) Patent No.: US 12,808,586 B2
(45) Date of Patent: Nov. 24, 2026

(54) EVAPORATION UNIT WITH DUAL LAYER SINTERED BODIES

(71) Applicant: Furukawa Electric Co., Ltd., Tokyo (JP)

(72) Inventors: Hirofumi Aoki, Tokyo (JP); Kenya Kawabata, Tokyo (JP); Hideaki Kawabata, Tokyo (JP); Yoshinori Nakamura, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 266 days.

(21) Appl. No.: 18/333,793

(22) Filed: Jun. 13, 2023

(65) Prior Publication Data

US 2023/0324091 A1 Oct. 12, 2023

Related U.S. Application Data

(63) Continuation of application No. PCT/JP2022/019035, filed on Apr. 27, 2022.

(30) Foreign Application Priority Data

Apr. 28, 2021 (JP) ..... 2021-076829

(51) Int. Cl.
*F25B 39/02* (2006.01)
*F28D 15/02* (2006.01)

(52) U.S. Cl.
CPC ..... *F25B 39/02* (2013.01); *F28D 15/0266* (2013.01); *F25B 2339/02* (2013.01)

(58) Field of Classification Search
CPC .. F25B 39/02; F25B 2339/02; F28D 15/0266; F28D 15/046
See application file for complete search history.

(56) References Cited

U.S. PATENT DOCUMENTS 3,840,069 A * 10/1974 Fischer ..... F28D 15/046 29/890.032
6,269,866 B1 * 8/2001 Yamamoto ..... F28D 15/0233 174/15.2

(Continued)

FOREIGN PATENT DOCUMENTS

CN 1383203 A 12/2002
CN 1697170 A 11/2005

(Continued)

OTHER PUBLICATIONS

[English Translation] First Office Action mailed Aug. 31, 2023 in CN Utility Model Application No. 202290000222.1; pp. all.

(Continued)

*Primary Examiner* — Travis Ruby
(74) *Attorney, Agent, or Firm* — Dorsey & Whitney LLP

(57) ABSTRACT

The evaporation unit structure of a heat transport member that is an evaporation unit structure of the heat transport member in which a container including an internal space in which the working fluid is enclosed includes an evaporation unit in which the working fluid in a liquid phase changes in phase, and a condensation unit in which the working fluid in a gas phase changes in phase, wherein a sintered body layer is provided on an inner surface of the evaporation unit, the sintered body layer with an average thickness n is composed of a first site that is a region of n/2 on an inner surface side of the container, and a second site that is a region of n/2 on the internal space side, and a percentage of voids of the first site is less than a percentage of voids of the second site.

17 Claims, 8 Drawing Sheets

(56) References Cited

U.S. PATENT DOCUMENTS 6,460,612 B1* 10/2002 Sehmbey ..... F28D 15/046 174/15.2
6,648,063 B1* 11/2003 Andraka ..... F28D 15/046 165/47
6,901,994 B1* 6/2005 Jin-Cherng ..... F28D 15/046 165/185
10,036,599 B1* 7/2018 Strehlow ..... F28D 15/0233
2004/0187501 A1 9/2004 Sauciuc et al.
2005/0022976 A1 2/2005 Rosenfeld et al.
2006/0124280 A1* 6/2006 Lee ..... F28D 15/046 257/E23.099
2006/0157229 A1* 7/2006 Hong ..... F28D 15/046 165/104.26
2006/0219391 A1* 10/2006 Hong ..... F28D 15/046 165/104.21
2007/0004232 A1 1/2007 Shareef et al.
2007/0107875 A1* 5/2007 Lee ..... F28D 15/0233 165/104.33
2007/0240855 A1* 10/2007 Hou ..... F28D 15/046 165/104.26
2009/0166008 A1 7/2009 Lai et al.
2010/0044018 A1 2/2010 Furberg et al.
2010/0071879 A1* 3/2010 Hou ..... F28D 15/046 29/890.032
2010/0139893 A1 6/2010 Ding et al.
2010/0307722 A1* 12/2010 Ryoson ..... F28D 15/046 228/265
2011/0253345 A1* 10/2011 Ryoson ..... B23K 20/16 165/104.26
2012/0279068 A1* 11/2012 Mahefkey ..... F28D 15/046 29/890.032
2013/0014919 A1* 1/2013 Dai ..... F28D 15/046 165/104.26
2013/0025829 A1* 1/2013 Huang ..... F28D 15/0233 165/104.26
2013/0168052 A1* 7/2013 Meyer, IV ..... B32B 5/16 428/402
2015/0060021 A1 3/2015 Chauhan et al.
2016/0018165 A1* 1/2016 Ahamed ..... F28D 15/0233 165/104.26
2016/0209123 A1* 7/2016 Yee ..... F28D 15/0233
2016/0252308 A1* 9/2016 Strehlow ..... F28D 15/046 165/104.26
2017/0350657 A1* 12/2017 Yeh ..... F28D 15/046
2018/0066897 A1* 3/2018 Lin ..... H05K 7/20336
2020/0080792 A1* 3/2020 Hirono ..... H01L 23/427
2020/0248969 A1* 8/2020 Sudhakar ..... F28D 15/046
2020/0355444 A1* 11/2020 Chen ..... F28D 15/046
2020/0404805 A1 12/2020 Gao
2021/0095930 A1* 4/2021 Inagaki ..... F28D 15/0233

FOREIGN PATENT DOCUMENTS

CN 1697171 A 11/2005
CN 108731525 A 11/2018
CN 111595187 A 8/2020
CN 112201635 A 1/2021
JP S5938510 B2 9/1984
JP 2000055577 A 2/2000
JP 2002022379 A 1/2002
JP 2013083385 A 5/2013
TW 200620601 A 6/2006
WO 2022230922 A1 11/2022

OTHER PUBLICATIONS

International Search Report and Written Opinion (English translation for ISR only) for International Application No. PCT/JP2022/019035 dated Jul. 19, 2022, pp. all.
Notice of the Opinion on Examination for Taiwanese Patent Application No. 111116168 dated Dec. 6, 2022, pp. all.
Second Office Action mailed Mar. 3, 2026 in JP Application No. 2022-546661 with (machine) English translation; pp. all.

* cited by examiner

EVAPORATION UNIT WITH DUAL LAYER SINTERED BODIES

CROSS REFERENCE TO RELATED APPLICATIONS

The present application is a continuation application of International Patent Application No. PCT/JP2022/019035 filed on Apr. 27, 2022, which claims the benefit of Japanese Patent Application No. 2021-076829, filed on Apr. 28, 2021. The contents of these applications are incorporated herein by reference in their entirety.

BACKGROUND

Technical Field

The present disclosure relates to an evaporation unit structure that can impart excellent heat transport characteristics to a heat transport member by being excellent in evaporation characteristics of a working fluid in a liquid phase that is enclosed in a container, and a heat transport member including the evaporation unit structure.

Background

Electronic components such as semiconductor devices mounted on electrical and electronic equipment have increased in heat generation amount due to high-density mounting and the like associated with high functionality, and cooling of the electronic components has become more important in recent years. As a cooling method of a heating element of an electronic component or the like, a heat transport member including a container having an internal space in which a working fluid is enclosed may be used. The aforementioned heat transport member cools the cooling target by the working fluid enclosed in the internal space of the container receiving heat from the electronic component that is the cooling target by changing in phase from a liquid phase to a gas phase in an evaporation unit of the container, and releasing heat received from the cooling target by changing in phase from the gas phase to a liquid phase in a condensation unit of the container.

In order to return the working fluid changed in phase from the gas phase to the liquid phase to the evaporation unit from the condensation unit, a wick structure having a capillary force is provided from the condensation unit to the evaporation unit inside the container. Accordingly, the wick structure is required to be excellent in evaporation characteristics of the working fluid in a liquid phase that is returned from the condensation unit, in the evaporation unit. As the wick structure, for example, a sintered body layer formed by sintering metal powder may be used.

As the sintered body layer formed by sintering metal powder, for example, it is proposed to form a powder sintered body of a porous structure, thereafter sinter raw material powder having a smaller particle size than the raw material powder forming the powder sintered body in a state of being interposed between the aforementioned powder sintered body and the inner wall surface of the container, whereby the aforementioned powder sintered body is fixed to the inner wall surface of the container to form a sintered powder layer (Japanese Patent Application Laid Open No. 2000-055577).

In Japanese Patent Application Laid Open No. 2000-055577, by metallically connecting the sintered powder layer and the container instead of mechanically connecting, heat resistance between the sintered powder layer and the container in the heat pipe is reduced, and the evaporation characteristics of the working fluid in a liquid phase are improved. Further, In Japanese Patent Application Laid Open No. 2000-055577, the wick structure has a two-layer structure of a bonding layer formed of small raw material powder and the sintered powder layer formed of large raw material powder, and by making the aforementioned two-layer structure have a structure in which sizes of voids in a thickness direction are different, so that the two-layer structure is excellent in flowability of the working fluid in a liquid phase even when the voids are densely set to obtain connection strength with the container.

However, In Japanese Patent Application Laid Open No. 2000-055577 that is a wick structure of a two-layer structure of the bonding layer formed of small raw material powder and the sintered powder layer formed of large raw material powder, a percentage of voids of the sintered powder layer formed of the large raw material powder is high, and excellent heat conductivity in the sintered powder layer cannot be obtained. Accordingly, in Japanese Patent Application Laid Open No. 2000-055577, there has been a need for improvement in evaporation characteristics of the working fluid in a liquid phase in the evaporation unit.

SUMMARY

The present disclosure is related to providing an evaporation unit structure excellent in evaporation characteristics of a working fluid in a liquid phase enclosed in a container, and a heat transport member including the evaporation unit structure.

A gist of a configuration of the present disclosure is as follows.

{1} An evaporation unit structure of a heat transport member in which a container including an internal space in which a working fluid is enclosed includes an evaporation unit in which the working fluid in a liquid phase changes in phase from the liquid phase to a gas phase, and a condensation unit in which the working fluid in a gas phase changes in phase from the gas phase to a liquid phase, the condensation unit being disposed in a different site from the evaporation unit, wherein a sintered body layer in which raw material particles containing a metal are sintered is provided on an inner surface of the evaporation unit of the container, and the sintered body layer with an average thickness n is composed of a first site that is a region of n/2 on an inner surface side of the container, and a second site that is a region of n/2 on the internal space side, and a percentage of voids of the first site is less than a percentage of voids of the second site.

{2} The evaporation unit structure according to clause {1}, wherein the raw material particles are a mixture including first raw material particles having a predetermined average primary particle size, and second raw material particles having an average primary particle size smaller than the first raw material particles.

{3} The evaporation unit structure according to clause {2}, wherein the average primary particle size of the first raw material particles is 50 μm or more and 300 μm or less, and the average primary particle size of the second raw material particles is 1.0 nm or more and 10 μm or less.

{4} The evaporation unit structure according to clause {2} or {3}, wherein the average primary particle size of the second raw material particles is 1.0 nm or more and 1000 nm or less.

{5} The evaporation unit structure according to any one of clauses {2} to {4}, wherein a ratio of the average primary particle size of the first raw material particles to the average primary particle size of the second raw material particles is 20 or more and 50000 or less.

{6} The evaporation unit structure according to any one of clauses {2} to {5}, wherein the raw material particles contain 10 parts by mass or more and 1000 parts by mass or less of the second raw material particles, with respect to 100 parts by mass of the first raw material particles.

{7} The evaporation unit structure according to any one of clauses {2} to {6}, wherein the first raw material particles contain particles of copper and/or a copper alloy, and the second raw material particles contain particles of copper and/or a copper alloy.

{8} The evaporation unit structure according to any one of clauses {1} to {7}, wherein an average size of voids of the second site is 1 μm or more and 200 μm or less.

{9} The evaporation unit structure according to any one of clauses {1} to {8}, wherein an average thickness n of the sintered body layer is 100 μm or more and 1.0 mm or less.

{10} A heat transport member, including the evaporation unit structure as set forth in any one of clauses {1} to {9}.

{11} The heat transport member according to clause {10}, wherein the heat transport member is a vapor chamber.

The above-described "evaporation unit" is a site of the container to which the heating element that is the cooling target of the heat transport member is thermally connected. It is possible to identify the "percentage of voids" in the above-described {1} by observing an area ratio of voids in a section of the evaporation unit structure by using a microscope such as a scanning electron endoscope (SEM).

The evaporation unit structure of the above-described {2} has the sintered body layer in which the raw material particles that is the mixture having the first raw material particles and the second raw material particles having the average primary particle size smaller than the first raw material particles are sintered. Since the raw material particles having the small average primary particle size has a strong cohesive force, by the above-described raw material particles being sintered, of the sintered body layer, in the first site that is the region on the inner surface side of the container, the second raw material particles are mainly agglomerated to be the sintered body in a bulk form, and in the second site that is the region on the internal space side, the second raw material particles are mainly agglomerated among the first raw material particles to be, as a result, the sintered body in which a large number of voids are formed.

According to an aspect of the evaporation unit structure of the present disclosure, the sintered body layer with an average thickness n is composed of the first site that is the region of n/2 on the inner surface side of the container, and the second site that is the region of n/2 on the internal space side, and the percentage of voids of the first site is less than the percentage of voids of the second site, whereby it is possible to obtain the evaporation unit structure excellent in evaporation characteristics of the working fluid in a liquid phase enclosed in the container. The reason why the evaporation unit structure of the present disclosure is excellent in evaporation characteristics of the working fluid in a liquid phase is considered to be that, of the sintered body layer, in the first site that is the region on the inner surface side of the container, the sintered body has excellent heat conductivity, whereas in the second site that is the region on the internal space side, the sintered body in which a large number of voids are formed is obtained, and therefore the starting point of evaporation of the working fluid in a liquid phase is provided, that is, in the second site, the evaporation promotion structure is formed. Further, in the evaporation unit structure of the present disclosure, the above-described first site and the above-described second site are included, and therefore, the heat resistance between the container and the sintered body layer is reduced to provide the evaporation unit structure excellent in evaporation characteristics. Further, according to an aspect of the evaporation unit structure of the present disclosure, the sintered body layer is the sintered body that are the mixture including the first raw material particles having the predetermined average primary particle size, and the second raw material particles having the average primary particle size smaller than the first raw material particles, the sintered body layer with the average thickness n is composed of the first site that is the region of n/2 on the inner surface side of the container, and the second site that is the region of n/2 on the internal space side, and the percentage of voids of the first site is less than the percentage of voids of the second site, whereby, of the sintered body layer, in the first site that is the region on the inner surface side of the container, the second raw material particles are mainly agglomerated to be the sintered body in a bulk form so as to have excellent heat conductivity, and in the second site that is the region on the internal space side, the sintered body in which a large number of voids are formed is formed so as to be the starting point of evaporation of the working fluid in a liquid phase. In other words, in the second site, since the evaporation promotion structure is formed, the evaporation unit structure is excellent in evaporation characteristics of the working fluid in a liquid phase.

According to an aspect of the evaporation unit structure of the present disclosure, the average primary particle size of the first raw material particles is 50 μm or more and 300 μm or less, and the average primary particle size of the second raw material particles is 1.0 nm or more and 10 μm or less, whereby in the first site that is the region on the inner surface side of the container, excellent heat conductivity is reliably obtained, and in the second site that is the region on the internal space side, the evaporation promotion structure is reliably obtained, so that the evaporation characteristics of the working fluid in a liquid phase are reliably improved.

According to an aspect of the evaporation unit structure of the present disclosure, the ratio of the average primary particle size of the first raw material particles to the average primary particle size of the second raw material particles is 20 or more and 50000 or less, whereby in the first site that is the region on the inner surface side of the container, excellent heat conductivity is reliably obtained, and in the second site that is the region on the internal space side, the evaporation promotion structure is reliably obtained, so that the evaporation characteristics of the working fluid in a liquid phase are reliably improved.

According to an aspect of the evaporation unit structure of the present disclosure, the average size of voids of the second site is 1 μm or more and 200 μm or less, whereby it is possible to obtain a more excellent evaporation promotion structure. Note that it is possible to identify the average size of the voids by observing a plurality of voids in the section of the evaporation unit structure by using a microscope such as a scanning electron microscope (SEM) to identify the sizes of the respective voids, and calculating an average value.

According to an aspect of the evaporation unit structure of the present disclosure, an average thickness n of the sintered body layer is 100 μm or more and 1.0 mm or less, whereby the vapor flow path through which the working fluid in a gas phase flows is reliably ensured while the working fluid in a liquid phase is reliably returned to the evaporation unit.

DETAILED DESCRIPTION

Figure 1:
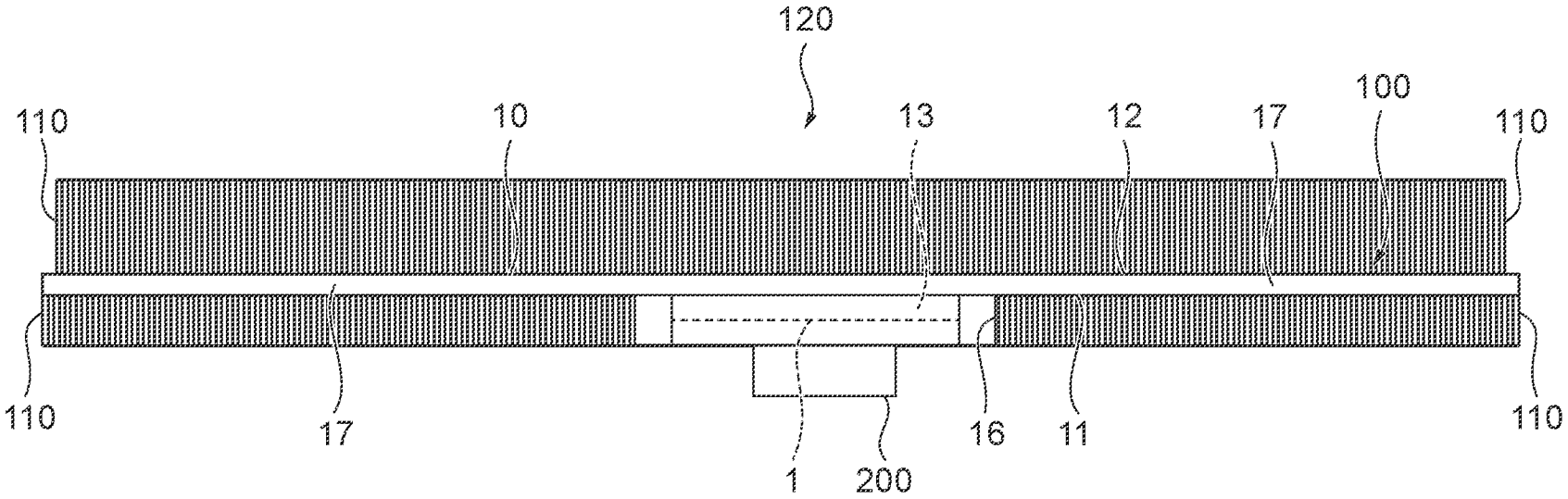
FIG. 1 is a side view illustrating a whole of a heat transport member including an evaporation unit structure according to a first embodiment example of the present disclosure.
Figure 2:
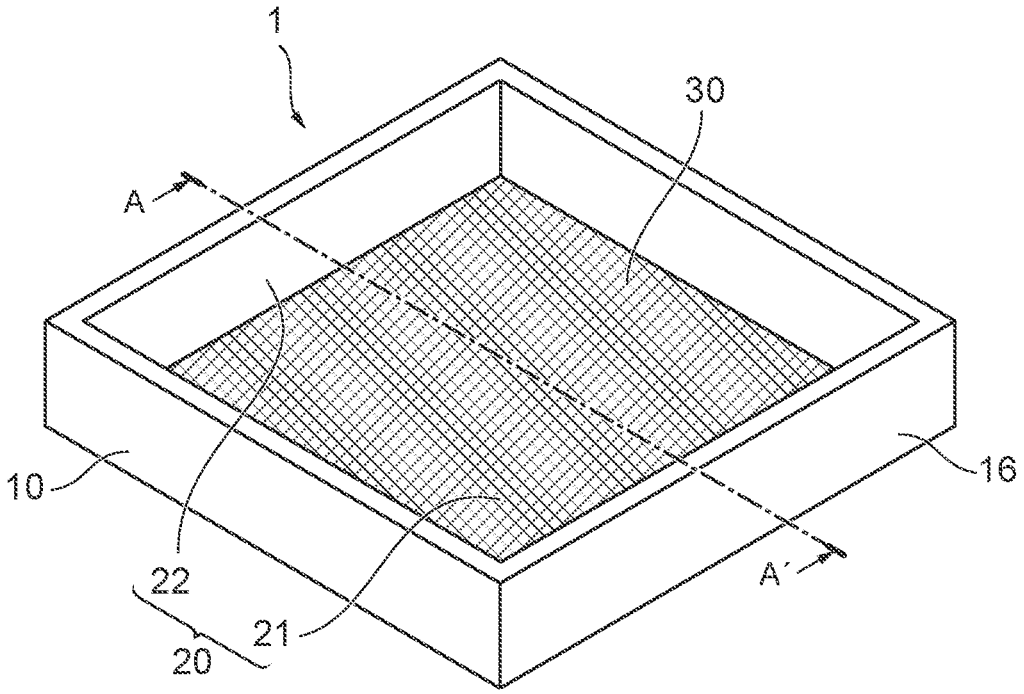
FIG. 2 is a perspective view explaining an outline of the evaporation unit structure according to the first embodiment example of the present disclosure.
Figure 3:
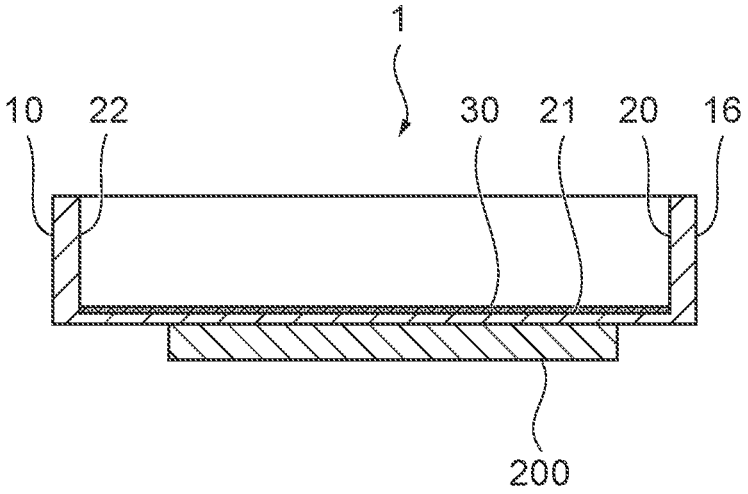
FIG. 3 is a sectional view along line A-A' in FIG. 2.
Figure 4:
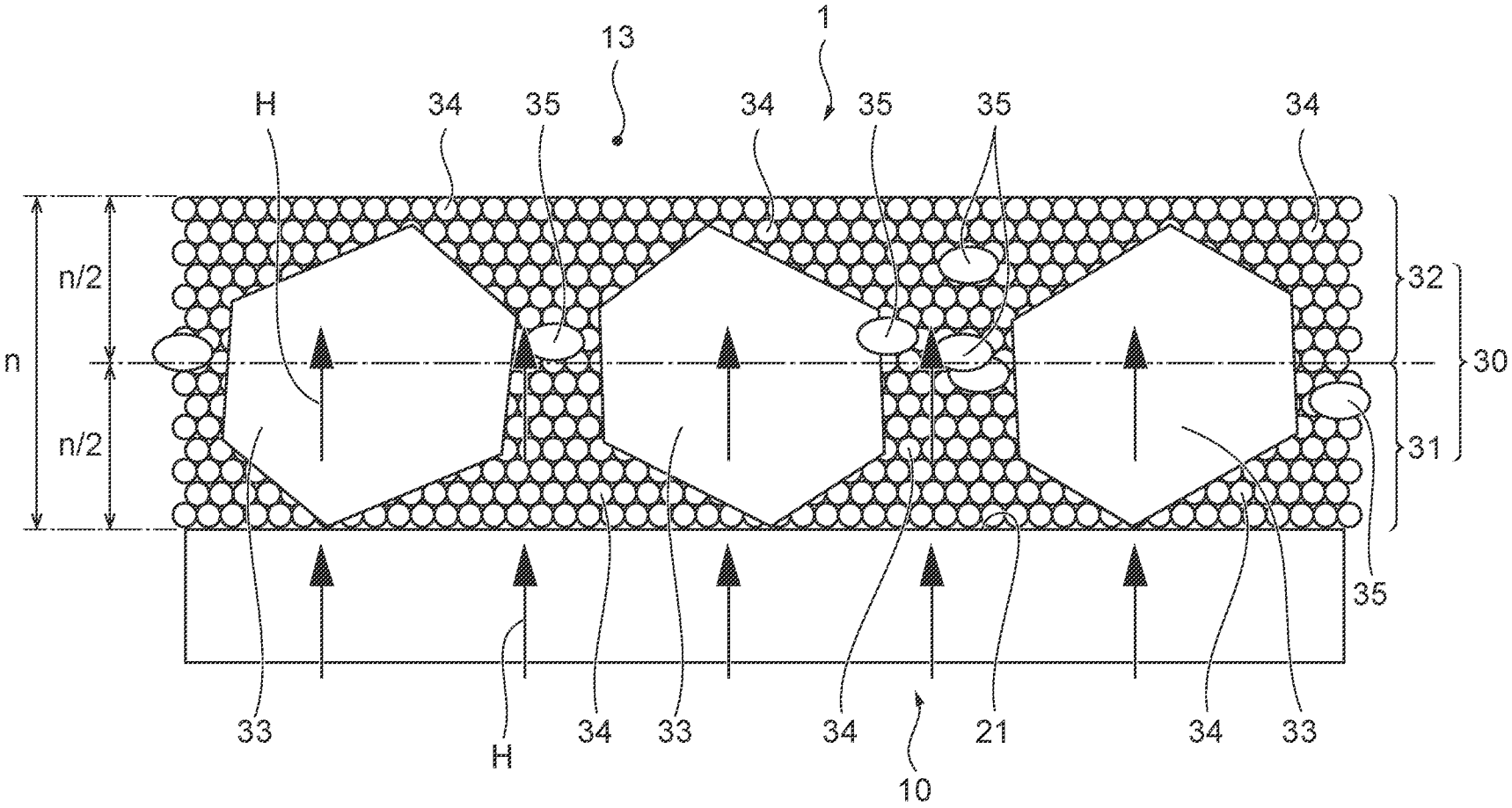
FIG. 4 is an explanatory view illustrating details of the evaporation unit structure according to the first embodiment example of the present disclosure.

Hereinafter, details will be described concerning an evaporation unit structure in a heat transport member according to a first embodiment example of the present disclosure. Note that FIG. 1 is a side view illustrating a whole of the heat transport member including the evaporation unit structure according to the first embodiment example of the present disclosure. FIG. 2 is a perspective view explaining an outline of the evaporation unit structure according to the first embodiment example of the present disclosure. FIG. 3 is a sectional view along line A-A' in FIG. 2. FIG. 4 is an explanatory view illustrating details of the evaporation unit structure according to the first embodiment example of the present disclosure.

As illustrated in FIG. 1, a heat transport member 100 including an evaporation unit structure 1 according to the first embodiment example of the present disclosure includes a container 10 in which an internal space that is a cavity portion 13 is formed, a working fluid (not illustrated) enclosed in the cavity portion 13, and a vapor flow path through which the working fluid in a gas phase flows, and which is provided in the cavity portion 13, by overlapping two facing plate-like bodies, that is, one plate-like body 11 and another plate-like body 12 facing the one plate-like body 11. The heat transport member 100 is formed by the container 10 in which the cavity portion 13 is formed inside, the working fluid, and the vapor flow path. In FIG. 1, a vapor chamber is used as the heat transport member 100 including the evaporation unit structure 1.

The container 10 is a thin plate-like container, and has a flat surface part 17 and a protruding part 16 protruded in an outward direction from the flat surface part 17. An internal space of the protruding part 16 of the container 10 communicates with an internal space of the flat surface part 17, and the cavity portion 13 of the container 10 is formed by the internal space of the protruding part 16 and the internal space of the flat surface part 17. Accordingly, the working fluid can flow between the internal space of the protruding part 16 and the internal space of the flat surface part 17. The cavity portion 13 is a sealed space, and is decompressed by degassing.

A shape of the container 10 is not particularly limited, but in the heat transport member 100, for example, a polygonal shape such as a quadrangular shape, a circular shape, an elliptical shape, a shape having a straight line portion and a bending portion, or the like are cited, in a plan view (state of viewing from a vertical direction to the flat surface part 17 of the container 10).

The protruding part 16 of the container 10 is not provided with a heat exchange unit such as a heat radiation fin. In the heat transport member 100, a heat exchange unit such as a heat radiation fin is also not provided in a tip end or a side surface of the protruding part 16. The protruding part 16 of the container 10 is a site to which a heating element 200 that is an element to be cooled is thermally connected, and the protruding part 16 functions as a heat reception unit of the heat transport member 100, that is, an evaporation unit of the container 10. The heating element 200 is thermally connected to the tip end of the protruding part 16. In the evaporation unit of the container 10, the working fluid in a liquid phase receives heat from the heating element 200, and thereby changes in phase to a gas phase. The heating element 200 is not particularly limited, and, for example, an electronic component such as a central processing unit mounted on a wiring board (not illustrated) is cited.

On the other hand, on the flat surface part 17 of the container 10, a plurality of heat radiation fins 110, 110, 110 . . . that are heat exchange units are provided to be raised, and the plurality of heat radiation fins 110, 110, 110 . . . are thermally connected to the container 10. The heat radiation fins 110 are arranged in parallel at predetermined intervals along an extending direction of the flat surface part 17. The heat radiation fins 110 are respectively provided to be raised on both surfaces of the container 10, that is, the one plate-like body 11 and the other plate-like body 12. In FIG. 1, the plurality of heat radiation fins 110, 110, 110 . . . are provided to be raised on the flat surface part 17 of the container 10, and a heat sink 120 is formed.

A site of the container 10 to which the heat radiation fins 110 are thermally connected functions as a heat radiation unit of the heat transport member 100, that is, a condensation unit of the container 10. In the condensation unit of the container 10, the working fluid in a gas phase changes in phase to a liquid phase to release latent heat by the heat exchange function of the heat exchange unit.

From the above, the container 10 having the cavity portion 13 that is the internal space in which the working fluid is enclosed includes the evaporation unit in which the working fluid in a liquid phase changes in phase from the liquid phase to a gas phase, and the condensation unit in which the working fluid in a gas phase changes in phase from the gas phase to a liquid phase, which is disposed in a different site from the evaporation unit. Form the above, the heat transport member 100 has an evaporation unit structure corresponding to the evaporation unit of the container 10.

In the cavity portion 13 of the container 10, a wick structure (not illustrated in FIG. 1) that generates a capillary force is provided. The wick structure is provided throughout the entire container 10, for example. By the capillary force of the wick structure, the working fluid that is changed in phase from a gas phase to a liquid phase in the condensation unit of the container 10 returns to the evaporation unit from the condensation unit of the container 10.

As illustrated in FIGS. 2 and 3, on an inner surface 20 of the protruding part 16 that is the evaporation unit of the container 10, a sintered body layer 30 in which raw material particles including a metal are sintered is provided as the wick structure. The sintered body layer 30 that is the wick structure forms the evaporation unit structure 1. In the evaporation unit structure 1, the sintered body layer 30 forming the evaporation unit structure 1 is provided on the tip end of the protruding part 16, that is, a bottom surface portion 21 of the protruding part 16 to which the heating element 200 is thermally connected, of the inner surface 20 of the protruding part 16. A front surface of the sintered body layer 30 is exposed to the internal space of the container 10. In the evaporation unit structure 1, the bottom surface portion 21 of the protruding part 16 is a flat surface. On the other hand, the sintered body layer 30 forming the evaporation unit structure 1 is not provided on a side surface portion 22, of the inner surface 20 of the protruding part 16.

Further, the sintered body layer 30 is provided in only the evaporation unit of the container 10, and the sintered body layer 30 is not provided in the site other than the evaporation unit, such as the condensation unit of the container 10. In the site other than the evaporation unit of the container 10, a wick structure that is a different structure from the sintered body layer 30 may be provided as necessary.

As shown in FIG. 4, the sintered body layer 30 forming the evaporation unit structure 1 has an average thickness n, and is composed of a first site 31 that is a region of n/2 on a bottom surface portion 21 inner surface side of the container 10, and a second site 32 that is a region of n/2 on an internal space (cavity portion 13) side of the container 10. From the above, the sintered body layer 30 has the first site 31 on a container 10 inner surface side, and the second site 32 on a cavity portion 13 side that is the internal space of the container 10, in a thickness direction of the sintered body layer 30. A front surface of the second site 32 is exposed to the cavity portion 13.

A particle size of the raw material particles containing a metal that is a raw material of the sintered body layer 30 is not particularly limited, and, for example, the raw material particles containing a metal that is the raw material of the sintered body layer 30 is a mixture having first raw material particles having a predetermined average primary particle size, and second raw material particles having a smaller average primary particle size than the first raw material particles. Accordingly, the sintered body layer 30 has a first raw material particle sintered portion 33 formed by the first raw material particles being sintered and a second raw material particle sintered portion 34 formed by the second raw material particles being sintered. Heat H of the heating element 200 thermally connected to the container 10 is transmitted to the sintered body layer 30 forming the evaporation unit structure 1 via the container 10.

As illustrated in FIG. 4, the sintered body layer 30 has a plurality of voids 35 inside. In the sintered body layer 30, a percentage of voids of the first site 31 is less than a percentage of voids of the second site 32. In the sintered body layer 30, a larger number of and/or larger voids 35 than the voids 35 of the first site 31 are in the second site 32. In the evaporation unit structure 1, the mixture having the first raw material particles having the predetermined average primary particle size and the second raw material particles having the smaller average primary particle size than the first raw material particles is used as the raw material particles, and the first raw material particle sintered portions 33 and the second raw material particle sintered portions 34 are formed by sintering the aforementioned raw material particles, whereby it is possible to obtain the sintered body layer 30 in which the percentage of voids of the first site 31 is less than the percentage of voids of the second site 32. Since the raw material particles having a small average primary particle size have a strong cohesive force, it is considered that by the raw material particles that are the mixture of the first raw material particles and the second raw material particles being sintered, the second raw material particles are mainly agglomerated to be a sintered body in a bulk form, in the first site 31 that is the region on the inner surface side of the container 10, of the sintered body layer 30. Further, it is considered that the raw material particles that are the mixture of the first raw material particles and the second raw material particles are sintered, whereby in the second site 32 that is the region on the cavity portion 13 side, the second raw material particles are mainly agglomerated between the first raw material particles and the first raw material particles, and as a result, become the sintered body in which a large number of and/or large voids 35 are formed.

The sintered body layer 30 of the above-described structure that forms the evaporation unit structure 1 can impart an evaporation unit structure of the heat transport member 100 excellent in evaporation characteristics of the working fluid in a liquid phase enclosed in the container 10. The reason why the evaporation unit structure 1 of the heat transport member 100 is excellent in evaporation characteristics of the working fluid in a liquid phase is considered to be that, of the sintered body layer 30, in the first site 31 that is the region on the inner surface side of the container 10, the sintered body has excellent heat conductivity because the sintered body is formed by the second raw material particles being mainly agglomerated into a bulk form, whereas in the second site 32 that is the region on the cavity portion 13 side that is the internal space of the container 10, the sintered body in which a larger number of and/or larger voids 35 as compared with the sintered body of the first site 31 is formed, and thus serves as a starting point for the working fluid in a liquid phase to be evaporated, that is, serves as an evaporation promotion structure in the second site 32. Further, the evaporation unit structure 1 of the heat transport member 100 has the first site 31 of the above-described structure and the second site 32 of the above-described structure, whereby the evaporation unit structure is excellent in evaporation characteristics with heat resistance between the container 10 and the sintered body layer 30 reduced.

Further, the sintered body layer 30 of the above-described structure can suppress heat conduction loss in an interface of a sintered portion by having the first raw material particle sintered portion 33 derived from the raw material particles having a relatively large particle size, and therefore can exhibit excellent heat conductivity.

As conditions for sintering for forming the sintered body layer 30 by sintering the raw material particles containing a metal, a heating temperature of 500° C. to 1000° C., and a heating time period of 60 minutes to 180 minutes are cited, for example.

The average primary particle size of the first raw material particles is not particularly limited, but a lower limit value of the average primary particle size of the first raw material particles is preferably 50 μm and more preferably 70 μm, from a viewpoint of being able to reliably obtain excellent heat conductivity in the first site 31 while reliably obtaining the evaporation promotion structure of the second site 32 by reliably making the percentage of voids of the second site 32 larger than the percentage of voids of the first site 31. On the other hand, an upper limit value of the average primary particle size of the first raw material particles is preferably 300 μm, and more preferably 200 μm, from a viewpoint of improving a capillary force of the sintered body layer 30 while reliably obtaining the evaporation promotion structure of the second site 32.

The average primary particle size of the second raw material particles is not particular limited as long as it is a particle size smaller than the average primary particle size of the first raw material particles, but a lower limit value of the average primary particle size of the second raw material particles is preferably 1.0 nm, more preferably 10 nm, and even more preferably 20 nm, from a viewpoint of being able to impart a proper cohesive force to the second raw material particles and reliably obtain the evaporation promotion structure of the second site 32. On the other hand, an upper limit value of the average primary particle size of the second raw material particles is preferably 10 μm, more preferably 3.0 μm, even more preferably 1000 nm, and even more preferably 500 nm, from a viewpoint of preventing occurrence of coarse voids between the first raw material particle sintered portions 33 to improve the capillary force and the heat conductivity of the sintered body layer 30.

A ratio of the average primary particle size of the first raw material particles to the average primary particle size of the second raw material particles is not particularly limited as long as the ratio is more than 1.0, but is preferably 20 or more and 50000 or less, and more preferably 30 or more and 10000 or less, from a viewpoint of being able to reliably obtain excellent heat conductivity in the first site 31 that is the region on the inner surface side of the container 10, reliably obtain the evaporation promotion structure in the second site 32 that is the region on the cavity portion 13 side, and reliably improve the evaporation characteristics of the working fluid in a liquid phase.

A blending ratio of the first raw material particles and the second raw material particles is not particularly limited, for example, but it is preferable to contain 10 parts by mass or more and 1000 parts by mass or less of the second raw material particles, and is more preferable to contain 20 parts by mass or more and 500 parts by mass or less of the second raw material particles, with respect to 100 parts by mass of the first raw material particles, from a viewpoint of being able to reliably obtain excellent heat conductivity in the first site 31 that is the region on the inner surface side of the container 10, and reliably obtain the evaporation promotion structure in the second site 32 that is the region on the cavity portion 13 side to reliably improve the evaporation characteristics of the working fluid in a liquid phase.

An average size of the voids 35 of the second site 32 is preferably 1 μm or more and 200 μm or less, and more preferably 10 μm or more and 100 μm or less, from a viewpoint of being able to obtain a more excellent evaporation promotion structure, for example. It is possible to adjust the average size of the voids 35 of the second site 32 by properly selecting the average primary particle size of the first raw material particles and the average primary particle size of the second raw material particles. Further, an average size of the voids 35 of the first site 31 is preferably 0.5 nm or more and 5 μm or less, and more preferably 5 nm or more and 1 μm or less, from a viewpoint of being able to obtain more excellent heat conductivity, for example. It is possible to adjust the average size of the voids 35 of the first site 31 by properly selecting the average primary particle size of the first raw material particles and the average primary particle size of the second raw material particles.

An average thickness n of the sintered body layer 30 is properly selectable according to use conditions or the like of the heat transport member 100, and is preferably 100 μm or more and 1.0 mm or less, from a viewpoint of the vapor flow path in which the working fluid in a gas phase flows being reliably ensured while the working fluid in a liquid phase is reliably returned to the evaporation unit, when the heat transport member 100 is a vapor chamber.

As the first raw material particles, it is possible to cite metal powder such as copper powder, copper alloy powder, or stainless steel powder. Further, as the second raw material particles, it is possible to cite metal powder such as copper powder, copper alloy powder, or stainless steel powder, like the first raw material particles. The first raw material particles and the second raw material particles may be powder of a same material type or may be powders of different material types.

The material of the container 10 is not particularly limited, for example, and it is possible to cite copper or a copper alloy from a viewpoint of being excellent in heat conductivity, aluminum, or an aluminum alloy from a viewpoint of light weight, and a metal such as stainless steel from a viewpoint of improvement in mechanical strength. Further, the working fluid to be enclosed in the container 10 is properly selectable according to the material of the container 10, and it is possible to cite water, CFC substitute, perfluorocarbon, cyclopentane or the like, for example.

As the wick structure that is provided at the site other than the evaporation unit of the container 10 and has a different structure from the sintered body layer 30, for example, it is possible to cite a sintered body of raw material particles of an average primary particle size different from the raw material particles of the sintered body layer 30, a sintered body with the raw material particles composed of the first raw material particles, or the like.

Next, a mechanism of a cooling function of the heat sink 120 using the heat transport member 100 including the evaporation unit structure 1 will be described. First, the heating element 200 that is an element to be cooled is thermally connected to the tip end of the protruding part 16 of the container 10. When the container 10 receives heat from the heating element 200 at the protruding part 16, in the protruding part 16 of the container 10, heat is transmitted to the working fluid in a liquid phase that stays in the sintered body layer 30 of the evaporation unit structure 1 from the heating element 200, and the working fluid in the liquid phase changes in phase to the working fluid in a gas phase. The working fluid in the gas phase flows through the vapor flow path of the cavity portion 13 from the protruding part 16 of the container 10 to the flat surface part 17, and diffuses throughout the entire flat surface part 17. The working fluid in a gas phase diffuses throughout the entire flat surface part 17 from the protruding part 16 of the container 10, whereby the container 10 transports the heat from the heating element 200 from the protruding part 16 to the entire container 10, and the heat from the heating element 200 diffuses to the entire container 10. The working fluid in the gas phase that can flow throughout the entire container 10 releases the latent heat by a heat exchange operation of the heat radiation fins 110 and changes in phase from the gas phase to a liquid phase. The released latent heat is transmitted to the heat radiation fins 110 that are thermally connected to the container 10. The heat transmitted to the heat radiation fins 110 from the container 10 is released to an external environment of the heat sink 120 via the heat radiation fins 110. The working fluid that releases the latent heat and changes in phase from the gas phase to the liquid phase returns to the protruding part 16 from the flat surface part 17 of the container 10 by the capillary force of the wick structure provided at the container 10.

Further, the heat sink 120 may be forcefully air-cooled by an air blowing fan (not illustrated) as necessary. Cooling air from the air blowing fan is supplied along main surfaces of the heat radiation fins 110, whereby the heat radiation fins 110 are cooled.

Figure 5:
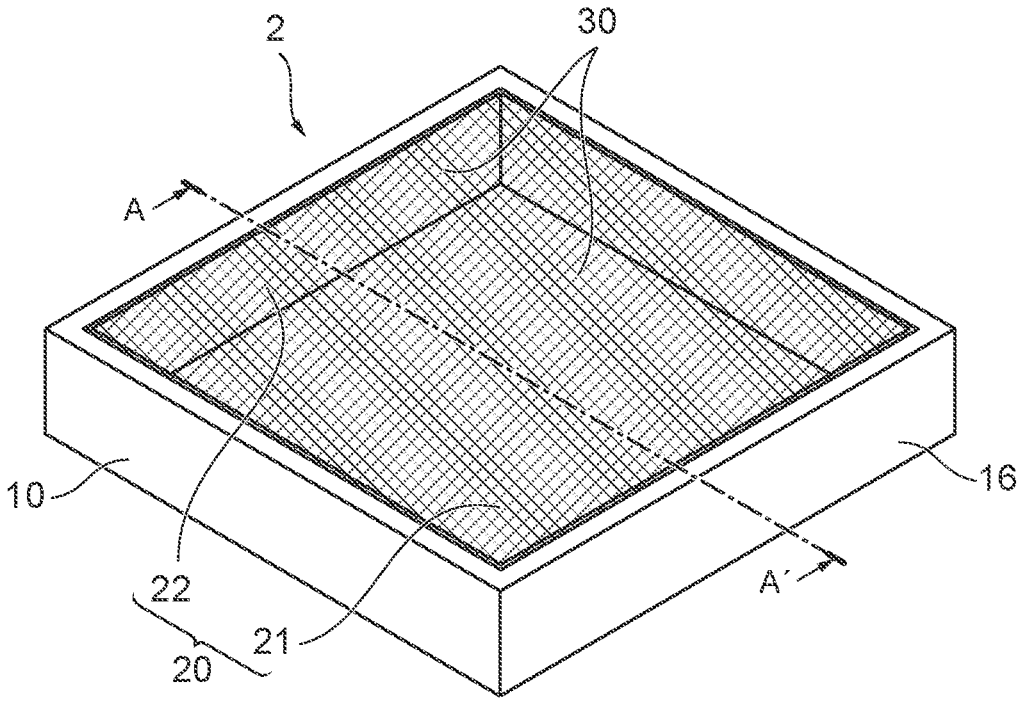
FIG. 5 is a perspective view explaining an outline of an evaporation unit structure according to a second embodiment example of the present disclosure.
Figure 6:
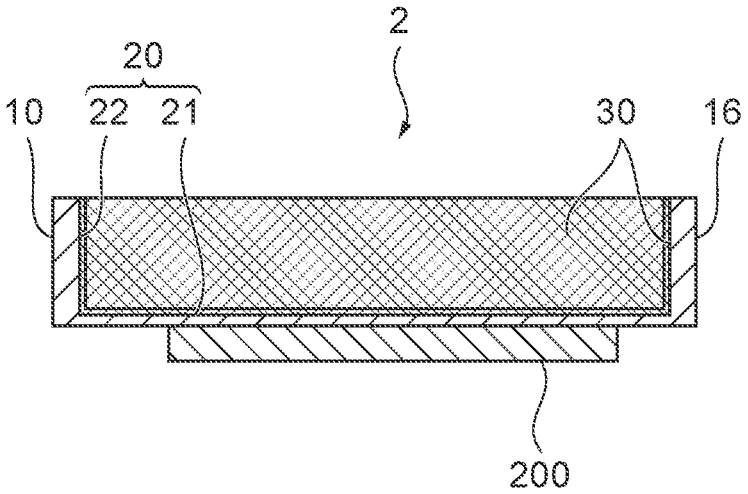
FIG. 6 is a sectional view along line A-A' in FIG. 5.

Next, details will be described concerning an evaporation unit structure in a heat transport member according to a second embodiment example of the present disclosure. Since the evaporation unit structure according to the second embodiment example has main components in common with the evaporation unit structure according to the first embodiment example, same components as the components of the evaporation unit structures according to the first embodiment example are described by using the same reference signs. Note that FIG. 5 is a perspective view explaining an outline of the evaporation unit structure according to the second embodiment example of the present disclosure. FIG. 6 is a sectional view along line A-A' in FIG. 5.

In the evaporation unit structure 1 according to the first embodiment example, the sintered body layer 30 is provided on the bottom surface portion 21 of the protruding part 16 to which the heating element 200 is thermally connected, of the inner surface 20 of the protruding part 16, and the sintered body layer 30 is not provided on the side surface portion 22 of the protruding part 16, but instead of this, as illustrated in FIGS. 5 and 6, in an evaporation unit structure 2 according to the second embodiment example, a sintered body layer 30 forming the evaporation unit structure 2 is provided not only on a bottom surface portion 21 of an inner surface 20 of the protruding part 16 but also on a side surface portion 22 in the protruding part 16 that is the evaporation unit of the container 10. Accordingly, in the evaporation unit structure 2, the sintered body layer 30 is provided on a substantially entire surface of the inner surface 20 of the protruding part 16.

In the evaporation unit structure 2, the sintered body layer 30 forming the evaporation unit structure 2 is also provided on the side surface portion 22, whereby evaporation characteristics of a working fluid in a liquid phase enclosed in the container 10 are improved throughout the substantially entire surface of the inner surface 20 of the protruding part 16, so that it is possible to provide the evaporation unit structure in which the evaporation characteristics of the working fluid in a liquid phase are further improved.

Figure 7:
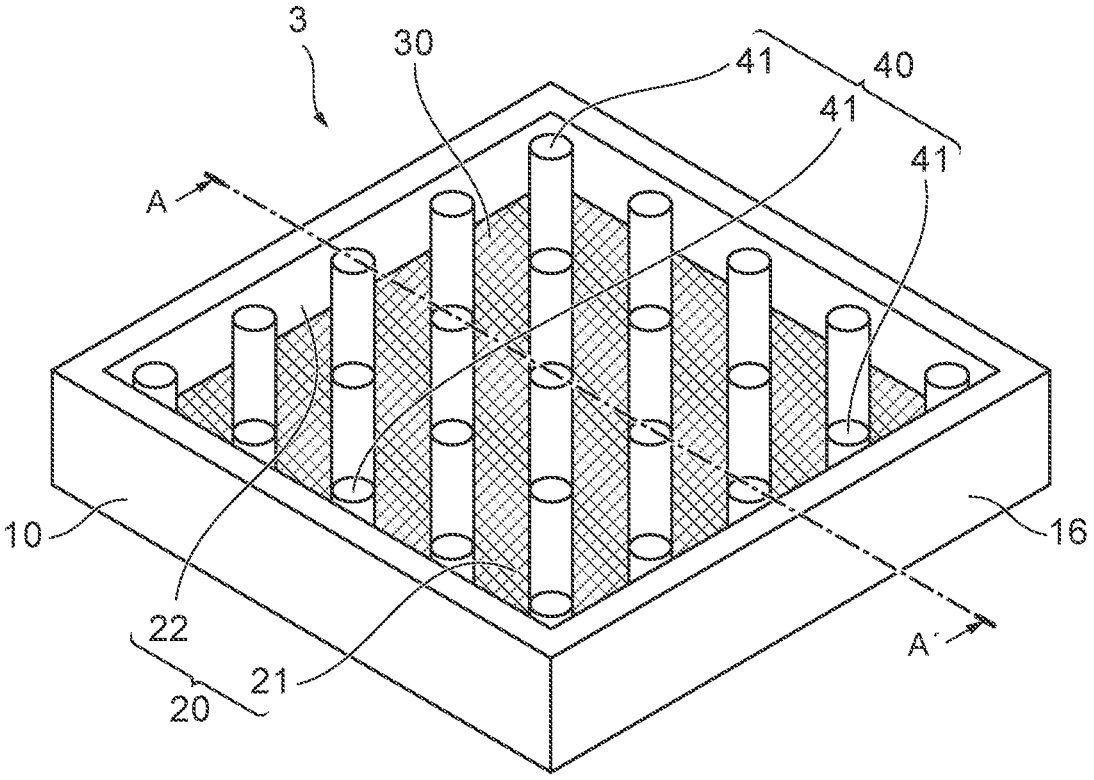
FIG. 7 is a perspective view explaining an outline of an evaporation unit structure according to a third embodiment example of the present disclosure.
Figure 8:
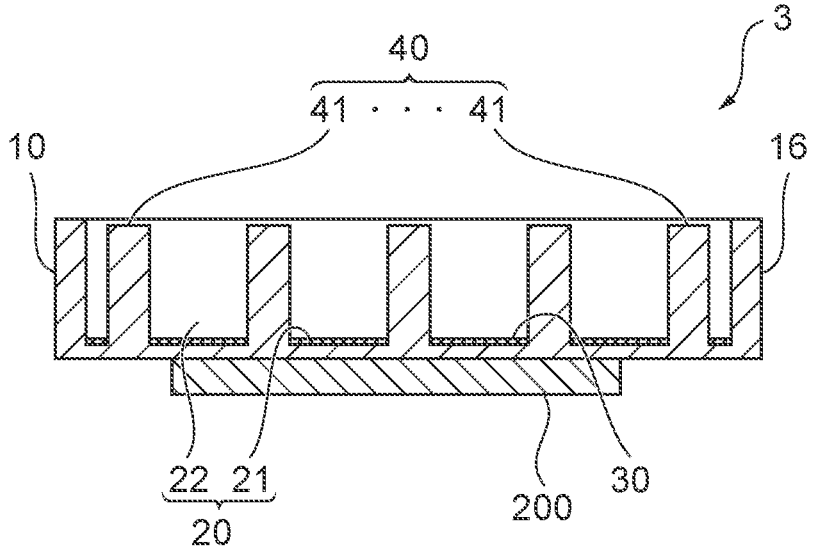
FIG. 8 is a sectional view along A-A' in FIG. 7.

Next, details will be described concerning an evaporation unit structure in a heat transport member according to a third embodiment example of the present disclosure. Since the evaporation unit structure according to the third embodiment example has main components in common with the evaporation unit structures according to the first and second embodiment examples, same components as the components of the evaporation unit structures according to the first and second embodiment examples are described by using the same reference signs. Note that FIG. 7 is a perspective view explaining an outline of the evaporation unit structure according to the third embodiment example of the present disclosure. FIG. 8 is a sectional view along line A-A' in FIG. 7.

As illustrated in FIGS. 7 and 8, in an evaporation unit structure 3 according to the third embodiment example, a plurality of fins 41, 41, 41 . . . each in a columnar shape are further provided to be raised on a bottom surface portion 21 of an inner surface 20 of a protruding part 16. The fin 41 in a columnar shape is a pin fin. The fin 41 in a columnar shape is a container inner surface area increasing portion 40 that increases a surface area in an evaporation unit in a container 10 inner surface. The plurality of fins 41, 41 41 . . . each in a columnar shape are disposed in parallel at predetermined intervals on the bottom surface portion 21. A shape of the fin 41 in a columnar shape is not particularly limited, and is a circular column shape in the evaporation unit structure 3. By the container inner surface area increasing portion 40 formed by the plurality of fins 41, 41, 41 . . . each in a columnar shape, the evaporation surface area of a working fluid in a liquid phase is increased, and heat transmission to the working fluid in a liquid phase from a heating element 200 via the container 10 is smoothened. As a result, a phase change to a gas phase of the working fluid in a liquid phase is promoted. As a method for forming the fin 41 in a columnar shape, a method of attaching the fin 41 in a columnar shape separately produced to the bottom surface portion 21 by soldering, brazing, sintering or the like is cited, for example.

In the evaporation unit structure 3, a sintered body layer 30 forming the evaporation unit structure 3 is provided on the bottom surface portion 21 of an inner surface 20 of a protruding part 16. Further, in the evaporation unit structure 3, the sintered body layer 30 is not provided on an outer surface of the fin 41 in a columnar shape and a side surface portion 22 of the protruding part 16.

It is possible to make even the evaporation unit structure 3 in which the container inner surface area increasing portion 40 is provided at the evaporation unit of the container 10 an evaporation unit structure excellent in evaporation characteristics of the working fluid in a liquid phase enclosed in the container 10 by the sintered body layer 30. Further, in the evaporation unit structure 3, the container inner surface area increasing portion 40 formed of the plurality of fins 4141, 41 . . . each in a columnar shape is provided, whereby the evaporation surface area of the working fluid in a liquid phase is increased to further reduce heat resistance at a time of the working fluid in a liquid phase changing in phase to a gas phase.

Figure 9:
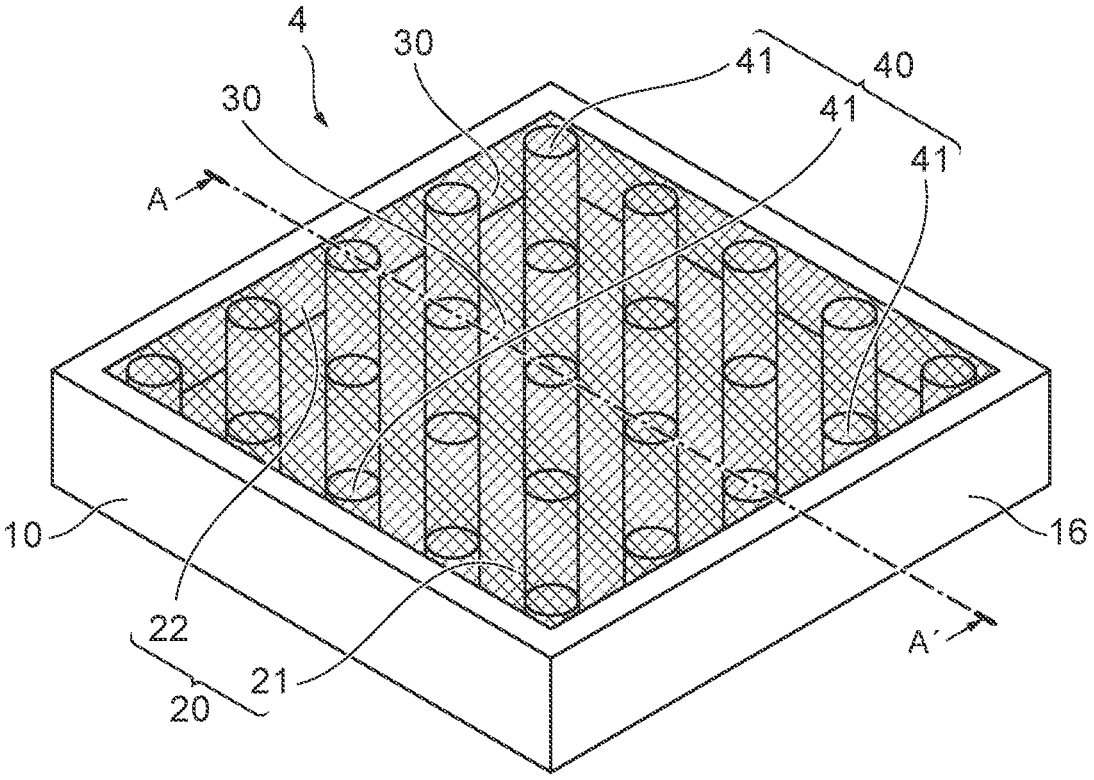
FIG. 9 is a perspective view explaining an outline of an evaporation unit structure according to a fourth embodiment example of the present disclosure.
Figure 10:
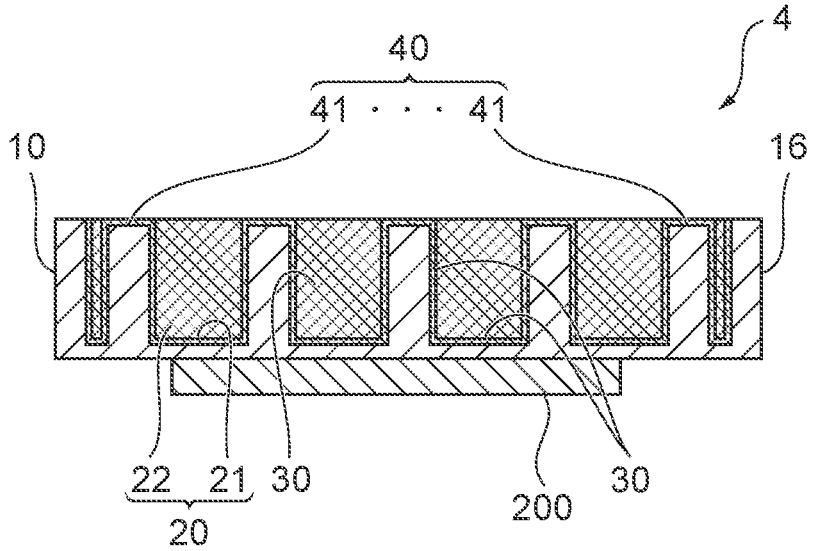
FIG. 10 is a sectional view along line A-A' in FIG. 9.

Next, details will be described concerning an evaporation unit structure in a heat transport member according to a fourth embodiment example of the present disclosure. Since the evaporation unit structure according to the fourth embodiment example has main components in common with the evaporation unit structures according to the first to the third embodiment examples, same components as the components of the evaporation unit structures according to the first to the third embodiment examples are described by using the same reference signs. Note that FIG. 9 is a perspective view explaining an outline of the evaporation unit structure according to the fourth embodiment example of the present disclosure. FIG. 10 is a sectional view along line A-A' in FIG. 9.

In the evaporation unit structure 3 according to the third embodiment example, of the inner surface 20 of the protruding part 16, the sintered body layer 30 is provided on the bottom surface portion 21 of the protruding part 16 to which the heating element 200 is thermally connected, and the sintered body layer 30 is not provided on outer surface of the fin 41 in a columnar shape and the side surface portion 22 of the protruding part 16, but instead of this, as shown in FIGS. 9 and 10, in an evaporation unit structure 4 according to the fourth embodiment example, a sintered body layer 30 forming the evaporation unit structure 4 is provided not only on a bottom surface portion 21 of an inner surface 20 of the protruding part 16, but also on a side surface portion 22, in the protruding part 16 that is an evaporation unit of a container 10. Further, in the evaporation unit structure 4, the sintered body layer 30 forming the evaporation unit structure 4 is also provided on an outer surface of the fin 41 in a columnar shape. Accordingly, the fin 41 in a columnar shape is covered with the sintered body layer 30.

In the evaporation unit structure 4, the sintered body layer 30 forming the evaporation unit structure 4 is also provided on the side surface portion 22, whereby the evaporation characteristics of the working fluid in a liquid phase enclosed in the container 10 are improved throughout a substantially entire surface of the inner surface 20 of the protruding part 16, so that it is possible to provide the evaporation unit structure further improved in the evaporation characteristics of the working fluid in a liquid phase. Further, in the evaporation unit structure 4, the sintered body layer 30 forming the evaporation unit structure 4 is also provided on the outer surface of the fin 41 in a columnar shape, whereby the working fluid in a liquid phase stays in the container inner surface area increasing portion 40 by the capillary force of the sintered body layer 30, and it is possible to prevent dry-out of the working fluid in a liquid phase in the evaporation unit.

Figure 11:
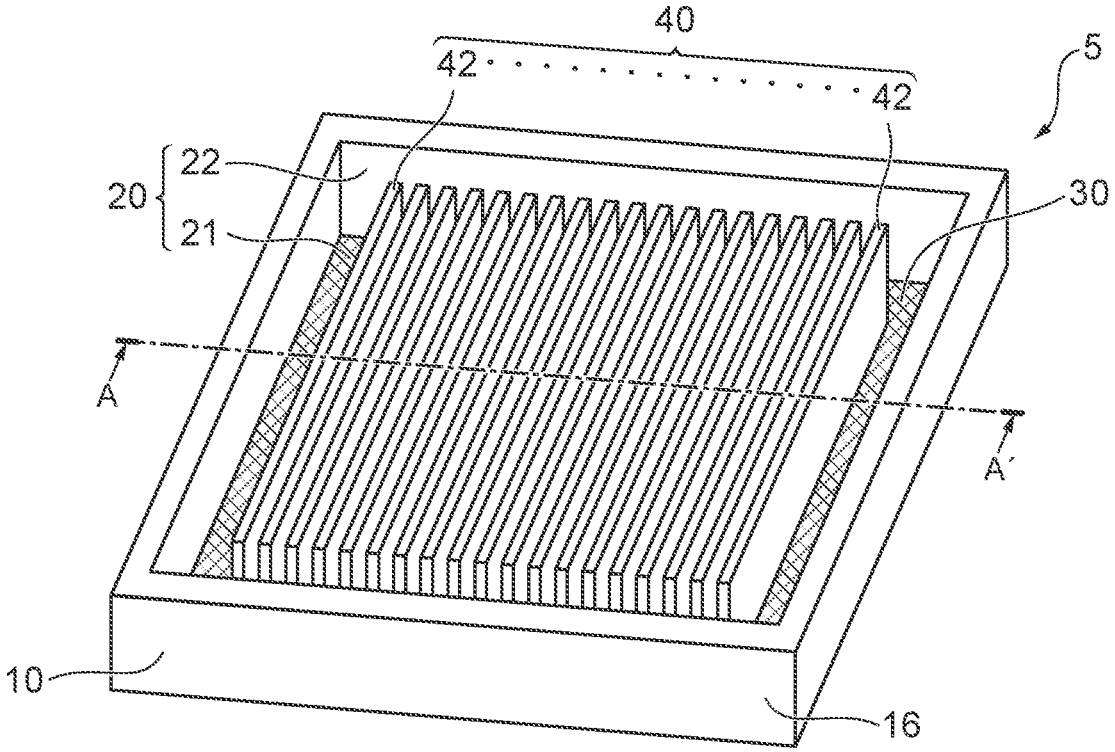
FIG. 11 is a perspective view explaining an outline of an evaporation unit structure according to a fifth embodiment example of the present disclosure.
Figure 12:
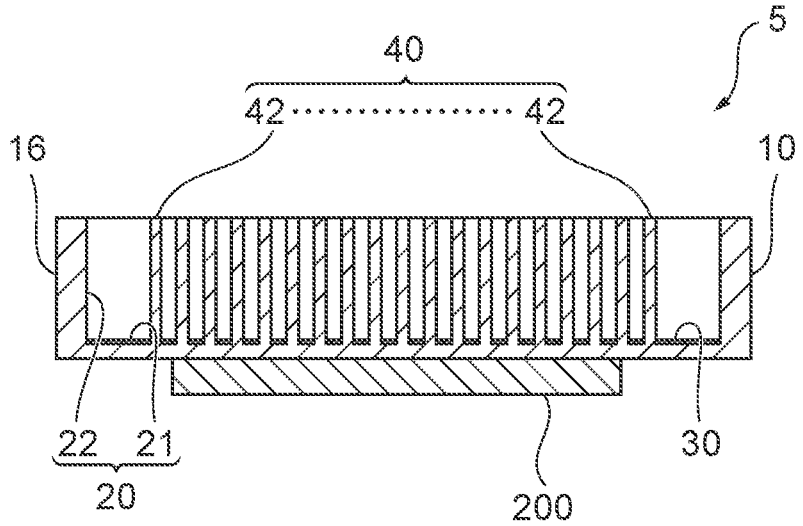
FIG. 12 is a sectional view along line A-A' in FIG. 11.

Next, details will be described concerning an evaporation unit structure in a heat transport member according to a fifth embodiment example of the present disclosure. Since the evaporation unit structure according to the fifth embodiment example has main components in common with the evaporation unit structures according to the first to the fourth embodiment examples, same components as the components of the evaporation unit structures according to the first to the fourth embodiment examples are described by using the same reference signs. Note that FIG. 11 is a perspective view explaining an outline of the evaporation unit structure according to the fifth embodiment example of the present disclosure. FIG. 12 is a sectional view along line A-A' in FIG. 11.

In the evaporation unit structure 3 according to the third embodiment example, the plurality of fins 41 41, 41 . . . each in a columnar shape are provided to be raised as the container inner surface area increasing portion 40, but instead of this, as illustrated in FIGS. 11 and 12, in an evaporation unit structure 5 according to the fifth embodiment example, a plurality of plate-like fins 42, 42, 42 . . . are provided to be raised as a container inner surface area increasing portion 40. The plurality of plate-like fins 42, 42, 42 . . . are disposed in parallel at predetermined intervals on a bottom surface portion 21 of an inner surface 20 of a protruding part 16. A shape of the plate-like fin 42 is not particularly limited, and is a thin plate with a quadrangular shape in front view, and a quadrangular shape in side view in the evaporation unit structure 5. By the container inner surface area increasing portion 40 formed of the plurality of plate-like fins 42, 42, 42 . . . , the evaporation surface area of the working fluid in a liquid phase is increased, and heat transmission to the working fluid in a liquid phase from a heating element 200 via a container 10 is smoothened. As a result, phase change of the working fluid in a liquid phase to a gas phase is promoted. As a method for forming the plate-like fin 42, for example, a method of attaching the plate-like fin 42 separately produced to the bottom surface portion 21 by soldering, brazing, sintering or the like is cited.

In the evaporation unit structure 5, the sintered body layer 30 forming the evaporation unit structure 5 is provided on the bottom surface portion 21 of the inner surface 20 of the protruding part 16. Further, in the evaporation unit structure 5, the sintered body layer 30 is not provided on an outer surface of the plate-like fin 42 and a side surface portion 22 of the protruding part 16.

It is possible to make even the evaporation unit structure 5 in which the container inner surface area increasing portion 40 is provided on the evaporation unit of the container 10 the evaporation unit structure excellent in evaporation characteristics of the working fluid in a liquid phase enclosed in the container 10 by the sintered body layer 30. Further, in the evaporation unit structure 5, the container inner surface area increasing portion 40 formed of the plurality of plate-like fins 42, 42, 42 . . . is provided, whereby the evaporation surface area of the working fluid in a liquid phase is increased to further reduce heat resistance at a time of the working fluid in a liquid phase changing in phase to a gas phase.

Figure 13:
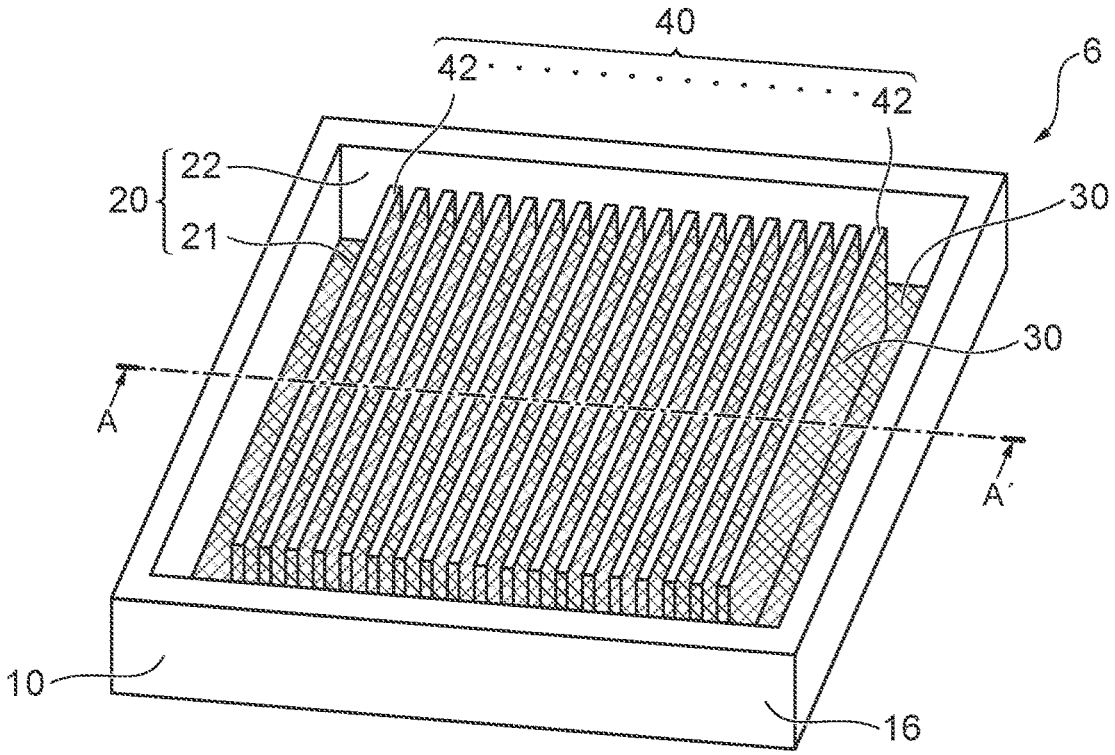
FIG. 13 is a perspective view explaining an outline of an evaporation unit structure according to a sixth embodiment example of the present disclosure.
Figure 14:
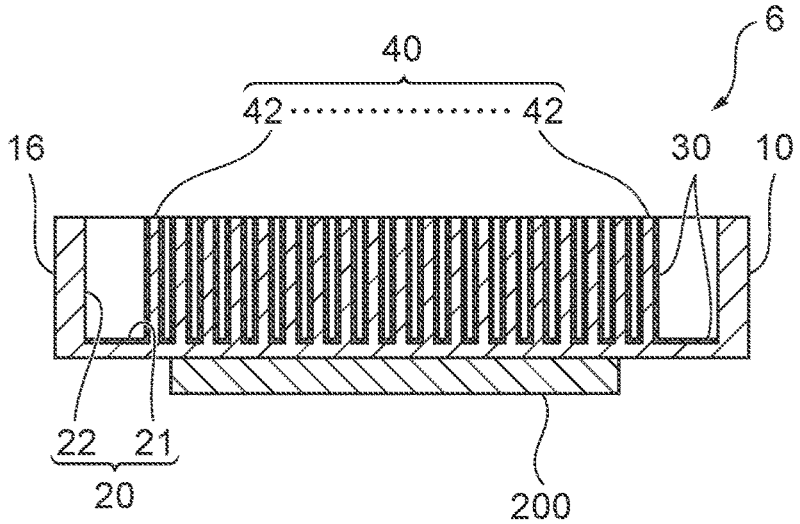
FIG. 14 is a sectional view along line A-A' in FIG. 13.

Next, details will be described concerning an evaporation unit structure in a heat transport member according to a sixth embodiment example of the present disclosure. Since the evaporation unit structure according to the sixth embodiment example has main components in common with the evaporation unit structures according to the first to the fifth embodiment examples, same components as the components of the evaporation unit structures according to the first to the fifth embodiment examples are described by using the same reference signs. Note that FIG. 13 is a perspective view explaining an outline of the evaporation unit structure according to the sixth embodiment example of the present disclosure. FIG. 14 is a sectional view along line A-A' in FIG. 13.

In the evaporation unit structure 5 according to the fifth embodiment example, of the inner surface 20 of the protruding part 16, the sintered body layer 30 is provided on the bottom surface portion 21 of the protruding part 16 to which the heating element 200 is thermally connected, and the sintered body layer 30 is not provided on the outer surface of the plate-like fin 42 and the side surface portion 22 of the protruding part 16, but instead of this, as illustrated in FIGS. 13 and 14, in an evaporation unit structure 6 according to the sixth embodiment example, a sintered body layer 30 forming the evaporation unit structure 6 is provided not only on a bottom surface portion 21 of an inner surface 20 of a protruding part 16 but also on an outer surface of a plate-like fin 42, in the protruding part 16 that is an evaporation unit of a container 10. Further, in the evaporation unit structure 6, the sintered body layer 30 forming the evaporation unit structure 6 is not provided on a side surface portion 22.

In the evaporation unit structure 6, the sintered body layer 30 forming the evaporation unit structure 6 is also provided on the outer surface of a plate-like fin 42, whereby evaporation characteristics of a working fluid in a liquid phase enclosed in the container 10 are improved throughout a substantially entire surface of the inner surface 20 of the protruding part 16, so that it is possible to provide the evaporation unit structure in which the evaporation characteristics of the working fluid in a liquid phase are further improved. Further, in the evaporation unit structure 6, a container inner surface area increasing portion 40 formed of a plurality of plate-like fins 42, 42, 42 . . . is provided, whereby an evaporation surface area of the working fluid in a liquid phase is increased to further reduce heat resistance at a time of the working fluid in a liquid phase changing in phase to a gas phase.

Next, other embodiment examples of the evaporation unit structure of the present disclosure will be described. In the evaporation unit structure according to each of the above-descried embodiment examples, the protruding part 16 is provided at the container 10, and the sintered body layer 30 is provided on the protruding part 16 that is the evaporation unit, but instead of this, a container 10 without being provided with a protruding part 16, for example, a container 10 in a flat surface shape may be used. In the case of the container 10 without being provided with the protruding part 16, a sintered body layer 30 is provided on a site of the container 10 to which a heating element that is a cooling target is thermally connected, and an evaporation unit structure is formed.

Further, in an embodiment example in which a sintered body layer 30 forming an evaporation unit structure is not provided on a side surface portion 22 of a protruding part 16 and a container inner surface area increasing portion 40, a wick structure that is a different structure from the sintered body layer 30 may be provided as necessary. As the wick structure of a different structure from the sintered body layer 30, for example, a sintered body of raw material particles of an average primary particle size different from raw material particles of the sintered body layer 30, a sintered body of the raw material particles of which are composed of first raw material particles, or the like is cited. Further, in the evaporation unit structure according to the fourth embodiment example, the sintered body layer 30 forming the evaporation unit structure is provided on the entire container inner surface area increasing portion 40 outer surface, but instead of this, the sintered body layer 30 may be provided on a partial region of the container inner surface area increasing portion 40 outer surface.

In the evaporation unit structure according to each of the above-described embodiment examples, a vapor chamber including a thin plate-like container is used as the heat transport member, but the heat transport member is not particularly limited as long as the heat transport member that includes a container having an internal space which is decompressed and has a working fluid enclosed in the internal space, and may be a heat pipe in which a shape of the container is a tubular body, for example.

The evaporation unit structure of the present disclosure is excellent in evaporation characteristics of the working fluid in a liquid phase enclosed in the container, and therefore, has a high utility value in the field of cooling a heating element with a large heat generation amount installed in a narrow space, for example.

What is claimed is:

1. An evaporation unit with dual layer sintered bodies of a heat transport member in which a container including an internal space in which a working fluid is enclosed comprises an evaporation unit in which the working fluid in a liquid phase changes in phase from the liquid phase to a gas phase, and a condensation unit in which the working fluid in a gas phase changes in phase from the gas phase to a liquid phase, the condensation unit being disposed in a different site from the evaporation unit, wherein a sintered body layer in which raw material particles containing a metal are sintered is provided on an inner surface of the evaporation unit of the container, the sintered body layer with an average thickness n comprises a first site that is a region of n/2 on an inner surface side of the container, and a second site that is a region of n/2 on the internal space side, and a percentage of voids of the first site is less than a percentage of voids of the second site, in the first site and the second site, the raw material particles are a mixture including first raw material particles having a predetermined average primary particle size, and second raw material particles having an average primary particle size smaller than the first raw material particles, the sintered body layer composed of mixture including the first raw material particles and the second raw material particles is provided only in the evaporation unit of the container, the container has a flat surface part and a protruding part protruded in an outward direction from the flat surface part, the protruding part functions as the evaporation unit, and heat exchange units are provided on the flat surface part.

2. The evaporation unit according to claim 1, wherein the average primary particle size of the first raw material particles is 50 μm or more and 300 μm or less, and the average primary particle size of the second raw material particles is 1.0 nm or more and 10 μm or less.

3. The evaporation unit according to claim 1, wherein the average primary particle size of the second raw material particles is 1.0 nm or more and 1000 nm or less.

4. The evaporation unit according to claim 2, wherein the average primary particle size of the second raw material particles is 1.0 nm or more and 1000 nm or less.

5. The evaporation unit according to claim 1, wherein a ratio of the average primary particle size of the first raw material particles to the average primary particle size of the second raw material particles is 20 or more and 50000 or less.

6. The evaporation unit according to claim 2, wherein a ratio of the average primary particle size of the first raw material particles to the average primary particle size of the second raw material particles is 20 or more and 50000 or less.

7. The evaporation unit according to claim 1, wherein the raw material particles contain 10 parts by mass or more and 1000 parts by mass or less of the second raw material particles, with respect to 100 parts by mass of the first raw material particles.

8. The evaporation unit according to claim 2, wherein the raw material particles contain 10 parts by mass or more and 1000 parts by mass or less of the second raw material particles, with respect to 100 parts by mass of the first raw material particles.

9. The evaporation unit according to claim 1, wherein the first raw material particles contain particles of copper and/or a copper alloy, and the second raw material particles contain particles of copper and/or a copper alloy.

10. The evaporation unit according to claim 2, wherein the first raw material particles contain particles of copper and/or a copper alloy, and the second raw material particles contain particles of copper and/or a copper alloy.

11. The evaporation unit according to claim 1, wherein an average size of voids of the second site is 1 μm or more and 200 μm or less.

12. The evaporation unit according to claim 2, wherein an average size of voids of the second site is 1 μm or more and 200 μm or less.

13. The evaporation unit according to claim 1, wherein an average thickness n of the sintered body layer is 100 μm or more and 1.0 mm or less.

14. The evaporation unit according to claim 2, wherein an average thickness n of the sintered body layer is 100 μm or more and 1.0 mm or less.

15. A heat transport member, comprising the evaporation unit according to claim 1.

16. The heat transport member according to claim 15, wherein the heat transport member is a vapor chamber.

17. The evaporation unit structure according to claim 1, wherein in the container, no sintered body layer in which raw material particles containing a metal are sintered is provided in the site other than the evaporation unit.

* * * * *